US011666090B2

(12) United States Patent
Reevell

(10) Patent No.: US 11,666,090 B2
(45) Date of Patent: Jun. 6, 2023

(54) AEROSOL-GENERATING DEVICE HAVING A SIDE CAVITY

(71) Applicant: Philip Morris Products S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 1131 days.

(21) Appl. No.: 16/304,833

(22) PCT Filed: May 26, 2017

(86) PCT No.: PCT/EP2017/062793

§ 371 (c)(1),
(2) Date: Nov. 27, 2018

(87) PCT Pub. No.: WO2017/207443

PCT Pub. Date: Dec. 7, 2017

(65) Prior Publication Data

US 2020/0008469 A1 Jan. 9, 2020

(30) Foreign Application Priority Data

May 31, 2016 (EP) ..... 16172276

(51) Int. Cl.
*A24F 40/30* (2020.01)
*H05B 3/00* (2006.01)
(Continued)

(52) U.S. Cl.
CPC ..... *A24F 40/30* (2020.01); *A24F 40/485* (2020.01); *H05B 3/0014* (2013.01); *H05B 3/44* (2013.01);
(Continued)

(58) Field of Classification Search
USPC ..... 131/194
See application file for complete search history.

(56) References Cited

U.S. PATENT DOCUMENTS 4,201,230 A * 5/1980 Howell, Jr. ..... A24F 1/30 131/257
9,498,002 B1 * 11/2016 Soreide ..... A24F 40/30
(Continued)

FOREIGN PATENT DOCUMENTS

CN 1284493 C 11/2006
CN 203872997 U 10/2014
(Continued)

OTHER PUBLICATIONS

Japanese Office Action dated May 13, 2021 in Japanese Patent Application No. 2018-556476 (with English translation), 6 pages.
(Continued)

*Primary Examiner* — Sang Y Paik
(74) *Attorney, Agent, or Firm* — Oblon, McClelland, Maier & Neustadt, L.L.P.

(57) ABSTRACT

An aerosol-generating device is provided, including an elongate housing having a first end, a second end, and a longitudinal axis extending between the first and the second ends; a cavity configured for insertion of an aerosol-generating article into the cavity along a first direction that is substantially perpendicular to the longitudinal axis; first and second apertures at first and second ends of the cavity and being configured for insertion and removal of the aerosol-generating article; an electrical power supply positioned within the elongate housing; at least one electrical heater, and a controller disposed within the elongate housing and configured to control a supply of electrical power from the
(Continued)

electrical power supply to the at least one electrical heater when the aerosol-generating article is received within the cavity.

14 Claims, 8 Drawing Sheets

(51) Int. Cl.

| | |
|---|---|
| ***H05B 3/44*** | (2006.01) |
| ***H05B 6/10*** | (2006.01) |
| ***A24F 40/485*** | (2020.01) |
| *A24F 40/10* | (2020.01) |

(52) U.S. Cl.
CPC ..... *H05B 6/108* (2013.01); *A24F 40/10* (2020.01); *H05B 2203/021* (2013.01)

(56) References Cited

U.S. PATENT DOCUMENTS

| | | | | |
|---|---|---|---|---|
| 2005/0016550 | A1 | 1/2005 | Katase | |
| 2009/0293888 | A1 | 12/2009 | Williams et al. | |
| 2011/0283996 | A1 | 11/2011 | Abrams | |
| 2013/0001477 | A1 | 1/2013 | Kimura et al. | |
| 2013/0037041 | A1 | 2/2013 | Worm et al. | |
| 2013/0327327 | A1* | 12/2013 | Edwards | B65D 83/753 128/203.11 |
| 2013/0333700 | A1 | 12/2013 | Buchberger | |
| 2014/0060554 | A1 | 3/2014 | Collett et al. | |
| 2014/0182608 | A1 | 7/2014 | Egoyants et al. | |
| 2014/0321837 | A1* | 10/2014 | Flick | F24H 9/2014 392/394 |
| 2015/0027459 | A1 | 1/2015 | Collett et al. | |
| 2015/0223515 | A1 | 8/2015 | McCullough | |
| 2015/0272225 | A1 | 10/2015 | Worm et al. | |
| 2016/0082203 | A1 | 3/2016 | McCullough | |

FOREIGN PATENT DOCUMENTS

| | | | |
|---|---|---|---|
| CN | 204317511 | U | 5/2015 |
| CN | 104768407 | A | 7/2015 |
| CN | 204796747 | U | 11/2015 |
| JP | 48-8231 | A | 3/1973 |
| JP | 7-184627 | A | 7/1995 |
| JP | 2005-34021 | A | 2/2005 |
| JP | 2015-532828 | A | 11/2015 |
| JP | 31-5390 | A | 4/2019 |
| KR | 10-2009-01 00400 | A | 9/2009 |
| KR | 10-2014-0006001 | A | 1/2014 |
| KR | 10-2015-0047616 | A | 5/2015 |
| WO | WO 95/27412 | A1 | 10/1995 |
| WO | WO 96/32854 | A2 | 10/1996 |
| WO | WO 98/23171 | A1 | 6/1998 |
| WO | WO 99/20940 | A1 | 4/1999 |
| WO | WO 01/70054 | A1 | 9/2001 |
| WO | WO 2013/022936 | A1 | 2/2013 |
| WO | WO 2013/102612 | A2 | 7/2013 |
| WO | WO 2015/101479 | A1 | 7/2015 |
| WO | WO 2015/179388 | A1 | 11/2015 |

OTHER PUBLICATIONS

Combined Chinese Office Action and Search Report dated Jan. 21, 2021 in Patent Application No. 2017800281844 (with English language translation), 19 pages.

Decision to Grant dated June 26, 2020 in corresponding Russian Patent Application No. 2018142129/03(070214) (with English Translation), 17 pages.

International Search Report and Written Opinion dated Sep. 11, 2017 in PCT/EP2017/062793 filed May 26, 2017.

"British American to Test Tobacco/E-cigarette Hybrid" Reuters, http://www.reuters.com/article/us-brit-am-tobacco-products-idUSKCN0T71U020151118, Nov. 18, 2015, 4 pages.

"HVS-Hybrid Vaping System" JINJIA Technologies, http://jinjiatech.com/PRODUCTS/Heat/91, 2009—2014, 2 pages.

Korean Office Action dated May 18, 2022 in Korean Patent Application No. 10-2018-7030879 (with English language translation), 10 pages.

Korean Notice of Allowance dated Dec. 22, 2022 in KR Application No. 2018-7030879 filed on May 26, 2017 (with English translation, total 3 pages).

* cited by examiner

AEROSOL-GENERATING DEVICE HAVING A SIDE CAVITY

CROSS-REFERENCE TO RELATED APPLICATIONS

This application is a U.S. national stage application of PCT/EP2017/062793, filed on May 26, 2017, which is based upon and claims the benefit of priority under 35 U.S.C. § 119 to European patent application no. 16172276.4, filed May 31, 2016, the entire contents of each of which are incorporated herein by reference.

TECHNICAL FIELD

The present invention relates to an aerosol-generating device having a cavity for insertion of an aerosol-generating article perpendicular to a longitudinal axis of the device. The present invention also relates to an aerosol-generating system comprising the aerosol-generating device.

DESCRIPTION OF THE RELATED ART

One type of aerosol-generating system is an electrically operated smoking system. Known handheld electrically operated smoking systems typically comprise an aerosol-generating device comprising a battery, control electronics and an electric heater for heating an aerosol-generating article designed specifically for use with the aerosol-generating device. In some examples, the aerosol-generating article comprises an aerosol-generating substrate, such as a tobacco rod or a tobacco plug, and the heater contained within the aerosol-generating device is inserted into or around the aerosol-generating substrate when the aerosol-generating article is inserted into the aerosol-generating device. In an alternative electrically operated smoking system, the aerosol-generating article may comprise a capsule containing an aerosol-generating substrate, such as loose tobacco.

In known electrically operated smoking systems the aerosol-generating article may be received within a cavity in the aerosol-generating device. In some electrically operated smoking systems it may be difficult to insert the article into the cavity or remove the article from the cavity. In some cases, it is necessary for a user to grasp a mouthpiece on the article or the device to facilitate insertion or removal, which may be undesirable.

It would be desirable to provide an aerosol-generating device that facilitates improved insertion of an aerosol-generating article into the aerosol-generating device. It would be desirable to provide an aerosol-generating device that facilitates improved removal of an aerosol-generating article from the aerosol-generating device.

SUMMARY

According to a first aspect of the present invention there is provided an aerosol-generating device comprising an elongate housing having a first end, a second end, and a longitudinal axis extending between the first end and the second end. The aerosol-generating device further comprises a cavity configured for insertion of an aerosol-generating article into the cavity along a first direction, wherein the first direction is substantially perpendicular to the longitudinal axis of the elongate housing. The aerosol-generating device also comprises an electrical power supply positioned within the housing, at least one electrical heater, and a controller positioned within the housing and configured to control a supply of electrical power from the electrical power supply to the at least one electrical heater when an aerosol-generating article is received within the cavity.

According to a second aspect of the present invention there is provided an aerosol-generating system comprising an aerosol-generating device according to the first aspect of the present invention and an aerosol-generating article configured for insertion into the cavity.

According to a third aspect of the present invention there is provided an aerosol-generating device comprising an elongate housing having a first end, a second end, and a longitudinal axis extending between the first end and the second end. The aerosol-generating device further comprises a cavity configured for insertion of an aerosol-generating article into the cavity along a first direction, wherein the first direction is substantially perpendicular to the longitudinal axis of the elongate housing. The aerosol-generating device also comprises an aerosol-generating cartridge comprising a liquid storage portion, a liquid aerosol-forming substrate contained within the liquid storage portion, and an aerosol-generating element configured for aerosolising the liquid aerosol-forming substrate. The aerosol-generating device comprises an electrical power supply positioned within the housing, and a controller positioned within the housing and configured to control a supply of electrical power from the electrical power supply to the aerosol-generating element.

According to a fourth aspect of the present invention there is provided an aerosol-generating system comprising an aerosol-generating device according to the third aspect of the present invention and an aerosol-generating article configured for insertion into the cavity.

BRIEF DESCRIPTION OF THE DRAWINGS

Embodiments of the invention are further described, by way of example only, with reference to the accompanying drawings, in which.

DETAILED DESCRIPTION

Figure 1:
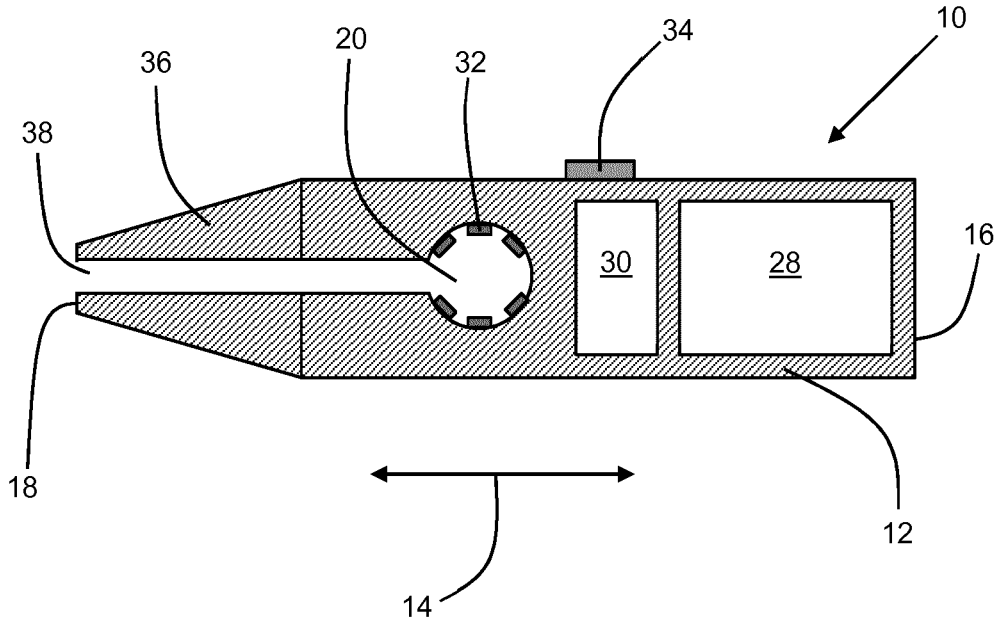
FIG. 1 shows a cross-sectional view of an aerosol-generating device in accordance with a first embodiment of the present invention.

The term "substantially perpendicular" is used herein to refer to angles between about 80 degrees and about 110 degrees, preferably between about 85 degrees and about 105 degrees, most preferably about 90 degrees.

The term "elongate" is used herein to refer to a shape having a length and a width extending substantially perpendicularly to the length, wherein the length is greater than the width. Preferably, the length is at least two times larger than the width.

Aerosol-generating devices according to the present invention comprise a cavity configured to receive an aerosol-generating article along a first direction substantially perpendicular to a longitudinal axis of the aerosol-generating device. That is, the aerosol-generating device is configured for insertion and removal of an aerosol-generating article through a side of the aerosol-generating device.

In embodiments in which the aerosol-generating device comprises a mouth end configured for insertion into a mouth of a user when using the aerosol-generating device, inserting and removing an aerosol-generating article through a side of the aerosol-generating device may advantageously facilitate insertion and removal of the aerosol-generating article without interfering with the mouth end of the aerosol-generating device.

The cavity configured for insertion and removal of an aerosol-generating article along a first direction substantially perpendicular to the longitudinal axis of the aerosol-generating device may advantageously facilitate separate insertion and removal of multiple aerosol-generating article in the cavity. That is, that cavity may be configured to simultaneously receive a plurality of aerosol-generating articles. Advantageously, this may facilitate user customisation of a smoking experience.

The aerosol-generating device may comprise a first aperture positioned at a first end of the cavity and extending through a portion of the elongate housing, wherein the aerosol-generating device is configured for insertion of an aerosol-generating article into the cavity through the first aperture.

The aerosol-generating device may comprise a second aperture positioned at a second end of the cavity and extending through a portion of the elongate housing, wherein the aerosol-generating device is configured for removal of an aerosol-generating article from the cavity through at least one of the first aperture and the second aperture. Advantageously, providing a second aperture may facilitate removal of an aerosol-generating article from the cavity. The aerosol-generating device may be configured so that a user may push against the aerosol-generating article via the second aperture so that the aerosol-generating article is pushed out of the cavity through the first aperture. The aerosol-generating device may be configured so that a user may push against the aerosol-generating article via the first aperture so that the aerosol-generating article is pushed out of the cavity through the second aperture. The aerosol-generating device may be configured so that an aerosol-generating article may be removed from the cavity through both of the first aperture and the second aperture.

The second aperture may be smaller than the first aperture. That is, the second aperture may have a cross-sectional area that is smaller than a cross-sectional area of the first aperture.

The second aperture may have a different shape to the first aperture.

Advantageously, providing a second aperture that is smaller than the first aperture, has a different shape to the first aperture, or both, may prevent a user from pushing an aerosol-generating article too far into the cavity when inserting the aerosol-generating article through the first aperture. That is, it may prevent a user from pushing the aerosol-generating article through the second aperture. Advantageously, the second aperture may be sufficiently large to facilitate removal of an aerosol-generating article from the cavity by enabling a user to push against the aerosol-generating article via the second aperture so that the aerosol-generating article is pushed out of the cavity through the first aperture.

The size of the second aperture may be equal to or larger than the size of the first aperture. That is, the second aperture may have a cross-sectional area that is equal to or larger than a cross-sectional area of the first aperture.

The second aperture may have substantially the same shape as the first aperture.

Advantageously, providing a second aperture having a size that is equal to or larger than the size of the first aperture, having substantially the same shape as the first aperture, or both, may facilitate removal of an aerosol-generating article from the cavity through the first aperture and the second aperture.

At least one of the first aperture and the cavity may comprise a tapering portion, wherein a cross-sectional area of the tapering portion decreases in the first direction. Advantageously, providing at least one of the first aperture and the cavity with a tapering portion may facilitate an interference fit between an aerosol-generating article and at least one of the first aperture and the cavity. Advantageously, an interference fit may facilitate retention of an aerosol-generating article in the cavity during use of the aerosol-generating device.

In embodiments comprising a second aperture, the second aperture may additionally or alternatively comprise a tapering portion. In such embodiments, the cross-sectional area of the tapering portion decreases in a direction opposite to the first direction.

The first aperture may form an airflow inlet so that air is drawn into the cavity through the first aperture during use of the aerosol-generating device.

In embodiments comprising a second aperture, the second aperture may additionally or alternatively form an airflow inlet so that air is drawn into the cavity through the second aperture during use of the aerosol-generating device.

The aerosol-generating device may comprise at least one airflow inlet provided at the first end of the elongate housing, wherein the at least one airflow inlet is in fluid communication with the cavity. The aerosol-generating device may comprise a mouth end and a distal end opposite the mouth end. The first end of the elongate housing may form the distal end of the aerosol-generating device.

The aerosol-generating device may comprise at least one airflow outlet provided at the second end of the elongate housing, wherein the at least one airflow outlet is in fluid communication with the cavity. The aerosol-generating device may comprise a mouth end and a distal end opposite the mouth end. The second end of the elongate housing may form the mouth end of the aerosol-generating device.

The aerosol-generating device may comprise a mouthpiece provided at the second end of the elongate housing.

The mouthpiece may be formed integrally with the elongate housing. In embodiments in which the aerosol-generating device comprises at least one airflow outlet at the second end of the elongate housing, the at least one airflow outlet may be provided in the mouthpiece.

The mouthpiece may be formed separately from the elongate housing and attached to the second end of the elongate housing. The mouthpiece may be removably attached to the second end of the elongate housing. The mouthpiece may be attached to the second end of the elongate housing by an interference fit. In embodiments in which the aerosol-generating device comprises at least one airflow outlet at the second end of the elongate housing, the at least one airflow outlet is preferably in fluid communication with the mouthpiece. The mouthpiece may comprise at least one mouthpiece airflow inlet in fluid communication with the at least one airflow outlet. The mouthpiece may comprise at least one airflow outlet in fluid communication with the at least one mouthpiece airflow inlet.

The at least one electrical heater is preferably positioned proximate the cavity.

The at least one electrical heater may at least partially surround the cavity.

The at least one electrical heater may be positioned within the cavity. The at least one electrical heater may comprise a plurality of electrical heaters spaced around an internal wall of the cavity. Each of the plurality of electrical heaters may comprise an elongate electrical heater. Each elongate electrical heater may comprise a length extending substantially in the first direction.

The at least one electrical heater may comprise at least one elongate electrical heater positioned on an internal wall of the cavity, the at least one elongate electrical heater extending into the cavity from the internal wall. The at least one elongate electrical heater may extend from an internal wall of the cavity opposite the first aperture. The at least one elongate electrical heater may extend in a direction substantially opposite the first direction. The at least one elongate electrical heater may be configured to pierce an aerosol-generating article when the aerosol-generating article is received within the cavity.

The at least one electrical heater may comprise at least one inductive heater. In use, the controller is configured to supply an alternating electrical current from the electrical power supply to the at least one inductive heater to generate a time-varying magnetic field. The time-varying magnetic field may heat a susceptor in an aerosol-generating article received within the cavity by electromagnetic induction.

The at least one electrical heater may comprise at least one resistive heater comprising an electrically resistive material. Suitable electrically resistive materials include but are not limited to: electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

The at least one electrical heater may comprise an infrared heating element or a photonic source.

The at least one electrical heater may comprise at least one semiconductor heater. The at least one semiconductor heater may comprise a substrate layer and a heating layer provided on the substrate layer. A suitable material for forming the substrate layer is silicon. The substrate layer may be a silicon wafer. The heating layer may comprise polycrystalline silicon. The heating layer may comprise one or more dopants to provide the polycrystalline silicon with a desired electrical resistance. A suitable dopant is phosphorous. The heating layer may be a substantially continuous layer. The heating layer may form a pattern on the substrate layer. Advantageously, providing a heating layer that forms a pattern on the substrate layer may provide a desired temperature distribution across the semiconductor heater during operation of the heater.

The cavity may be configured to simultaneously receive a plurality of aerosol-generating articles. Advantageously, an aerosol-generating device configured to simultaneously receive a plurality of aerosol-generating articles may facilitate user customisation of a smoking experience. A user may choose a desired number of aerosol-generating articles for simultaneous use to provide a desired amount of aerosol delivery. A user may choose two or more different types of aerosol-generating article for simultaneous use to provide a desired aerosol composition. A user may choose one or more aerosol-generating articles providing one or more flavours to provide a customised flavour profile.

The cavity may be a single cavity configured to simultaneously receive a plurality of aerosol-generating articles. The cavity may be configured to simultaneously receive a plurality of aerosol-generating articles each comprising a substantially round cross-sectional shape. At least a portion of an internal surface of the cavity may be scalloped to facilitate correct insertion of a plurality of aerosol-generating article into the cavity. At least a portion of an edge of the first aperture may be scalloped to facilitate correct insertion of a plurality of aerosol-generating articles into the cavity.

The cavity may comprise a first cavity configured for insertion of a first aerosol-generating article into the first cavity along the first direction, the aerosol-generating device further comprising a second cavity configured for insertion of a second aerosol-generating article into the second cavity along a second direction, wherein the second direction is substantially perpendicular to the longitudinal axis of the elongate housing. The first direction may be substantially parallel to the second direction.

The aerosol-generating device may comprise any number of additional cavities each configured for insertion of an aerosol-generating article into the cavity along a direction substantially perpendicular to the longitudinal axis of the elongate housing, optionally parallel to the first direction.

The second cavity and any additional cavities may each comprise any of the optional or preferred features described herein, including a first aperture, a second aperture, one or more tapering portions, one or more electrical heaters positioned proximate the cavity, and combinations thereof.

The electrical power supply may comprise a direct current (DC) source. In preferred embodiments, the electrical power supply comprises a battery. The electrical power supply may comprise a Nickel-metal hydride battery, a Nickel cadmium battery, or a Lithium based battery, for example a Lithium-Cobalt, a Lithium-Iron-Phosphate or a Lithium-Polymer battery.

According to a second aspect of the present invention there is provided an aerosol-generating system comprising an aerosol-generating device according to the first aspect of the present invention and an aerosol-generating article configured for insertion into the cavity. The aerosol-generating system may be configured so that the aerosol-generating article is retained within the cavity by an interference fit when the aerosol-generating article is received within the cavity. At least one of the cavity and the first aperture may comprise a tapering portion, as described herein. The aerosol-generating article may comprise a tapering portion.

The aerosol-generating article may be a plurality of aerosol-generating articles, wherein the aerosol-generating device is configured to simultaneously receive the plurality of aerosol-generating articles, as described herein.

The aerosol-generating article may comprise a first aerosol-generating article, a second aerosol-generating article, and a wrapper connecting the first aerosol-generating article to the second aerosol-generating article, the wrapper comprising a frangible portion. The aerosol-generating article may be configured so that, prior to insertion of the aerosol-generating article into the cavity, a user may at least partially detach the first aerosol-generating article from the second aerosol-generating article along the frangible portion of the wrapper.

Preferably, the cavity is configured to receive the aerosol-generating article when the first aerosol-generating article has been at least partially detached from the second aerosol-generating article.

The cavity may be a single cavity configured to receive the aerosol-generating article when the first aerosol-generating article is at least partially detached from the second aerosol-generating article. The cavity may be a single cavity configured to receive a plurality of aerosol-generating articles, as described herein. The cavity may comprise a scalloped internal surface.

The cavity may comprise a first cavity configured to receive the first aerosol-generating article and a second cavity configured to receive the second aerosol-generating article when the first aerosol-generating article has been completely detached from the second aerosol-generating article. The aerosol-generating device may be an aerosol-generating device comprising a first cavity and a second cavity, as described herein.

The aerosol-generating article preferably comprises an aerosol-forming substrate. The term "aerosol-forming substrate" is used herein to describe a substrate capable of releasing volatile compounds, which can form an aerosol. The aerosols generated from aerosol-forming substrates of aerosol-generating articles according to the invention may be visible or invisible and may include vapours (for example, fine particles of substances, which are in a gaseous state, that are ordinarily liquid or solid at room temperature) as well as gases and liquid droplets of condensed vapours.

In embodiments in which the aerosol-generating article comprises a plurality of aerosol-generating articles, each aerosol-generating article preferably comprises an aerosol-forming substrate.

The aerosol-forming substrate may comprise a solid aerosol-forming substrate. The aerosol-forming substrate may comprise tobacco. The aerosol-forming substrate may comprise a tobacco-containing material containing volatile tobacco flavour compounds which are released from the substrate upon heating. The aerosol-forming substrate may comprise a non-tobacco material. The aerosol-forming substrate may comprise tobacco-containing material and non-tobacco containing material.

The aerosol-forming substrate may include at least one aerosol-former. Suitable aerosol-formers include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. Alternatively, the aerosol-forming substrate may comprise a combination of two or more aerosol formers.

The aerosol-forming substrate may have an aerosol former content of greater than 5 percent on a dry weight basis.

The aerosol-forming substrate may have an aerosol former content of between approximately 5 percent and approximately 30 percent on a dry weight basis.

The aerosol-forming substrate may have an aerosol former content of approximately 20 percent on a dry weight basis.

The aerosol-forming substrate may comprise a liquid aerosol-forming substrate.

The liquid aerosol-forming substrate may comprise a nicotine solution. The liquid aerosol-forming substrate preferably comprises a tobacco-containing material comprising volatile tobacco flavour compounds which are released from the liquid upon heating. The liquid aerosol-forming substrate may comprise a non-tobacco material. The liquid aerosol-forming substrate may include water, solvents, ethanol, plant extracts and natural or artificial flavours. Preferably, the liquid aerosol-forming substrate further comprises an aerosol former.

The liquid aerosol-forming substrate may comprise an acid source. The acid source may comprise an organic acid or an inorganic acid. Preferably, the acid source comprises an organic acid, more preferably a carboxylic acid, most preferably an alpha-keto or 2-oxo acid or lactic acid.

Preferably, the acid comprises an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid, lactic acid and combinations thereof. Advantageously, the acid comprises pyruvic acid or lactic acid. More advantageously, the acid comprises lactic acid.

The liquid aerosol-forming substrate may be impregnated into a carrier material. Preferably, the carrier material has a density of between about 0.1 grams/cubic centimetre and about 0.3 grams/cubic centimetre. Preferably, the carrier material has a porosity of between about 15 percent and about 55 percent.

The carrier material may comprise one or more of glass, cellulose, ceramic, stainless steel, aluminium, polyethylene (PE), polypropylene, polyethylene terephthalate (PET), poly (cyclohexanedimethylene terephthalate) (PCT), polybutylene terephthalate (PBT), polytetrafluoroethylene (PTFE), expanded polytetrafluoroethylene (ePTFE), and BAREX®.

Preferably, the carrier material is chemically inert with respect to the liquid aerosol-forming substrate.

The aerosol-forming substrate may comprise at least one flavourant. A suitable flavourant may include menthol.

In embodiments in which the aerosol-generating article is a plurality of aerosol-generating articles simultaneously received within the aerosol-generating device, at least some of the aerosol-generating articles may comprise different aerosol-forming substrates.

At least one of the aerosol-generating articles may comprise a solid aerosol-forming substrate and at least one of the aerosol-generating articles may comprise a liquid aerosol-forming substrate, as described herein.

At least one of the aerosol-generating articles may comprise a liquid nicotine source and at least one of the aerosol-generating articles may comprise an acid source. In use, nicotine from the nicotine source and acid from the acid source may react in the gas phase to form an aerosol comprising nicotine salt particles for delivery to a user.

The plurality of aerosol-generating articles may comprise any combination of aerosol-forming substrates described herein.

Advantageously, an aerosol-generating system comprising an aerosol-generating device configured to receive a plurality of aerosol-generating articles may facilitate user customisation of a smoking experience. A user may select aerosol-generating articles to provide a desired combination of any of the aerosol-forming substrates described herein.

Aerosol-generating devices according to both the first aspect of the present invention and the second aspect of the present invention may comprise an aerosol-generating cartridge comprising a liquid storage portion, a liquid aerosol-forming substrate contained within the liquid storage portion, and at least one aerosol-generating element configured for aerosolising the liquid aerosol-forming substrate. The liquid aerosol-forming substrate may comprise any of the liquid aerosol-forming substrates described herein. Preferably, the liquid aerosol-forming substrate comprises a liquid nicotine source.

Preferably, the aerosol-generating device is configured so that, in use, airflow through the aerosol-generating device flows across the aerosol-generating element and through the cavity. The airflow may flow through the cavity before or after flowing across the aerosol-generating element.

The liquid storage portion may comprise a liquid storage container containing the liquid aerosol-forming substrate. The liquid storage container may be formed from a substantially transparent material, such as ALTUGLAS® Medical Resins Polymethlymethacrylate (PMMA), Chevron Phillips K-Resin® Styrene-butadiene copolymer (SBC), Arkema special performance polymers Pebax®, Rilsan®, and Rilsan® Clear, DOW (Health+™) Low-Density Polyethylene (LDPE), DOW™ LDPE 91003, DOW™ LDPE 91020 (MFI 2.0; density 923), ExxonMobil™ Polypropylene (PP) PP1013H1, PP1014H1 and PP9074MED, Trinseo CALIBRE™ Polycarbonate (PC) 2060-SERIES. The liquid storage container may be moulded, such as by in an injection moulding process.

Preferably, the liquid storage container comprises an outlet in the liquid storage container for delivery of the liquid aerosol-forming substrate from the liquid storage container. The outlet may be provided in an end of the liquid storage container. The aerosol-generating article may further comprise a liquid transport element extending through the outlet, the liquid transport element having a first portion positioned within the liquid storage container. Advantageously, the liquid transport element may facilitate controlled delivery of the liquid aerosol-forming substrate from the liquid storage container, through the outlet.

The liquid transport element may comprise a capillary wick. The capillary wick may be formed from capillary fibres, including glass fibres, carbon fibres, and metallic fibres, or a combination of any and all of glass fibres, carbon fibres and metallic fibres. Providing metallic fibres may enhance the mechanical resistance of the wick without negatively affecting the hydrophobic properties of the overall wick. Such fibres may be provided parallel to the central axis of the wick, and may be braided, twisted or partially non-woven.

The capillary wick may have a fibrous or spongy structure. The capillary wick preferably comprises a bundle of capillaries. For example, the capillary wick may comprise a plurality of fibres or threads, or other fine bore tubes. The fibres or threads may be generally aligned in a longitudinal direction of the aerosol-generating article. The capillary wick may comprise sponge-like or foam-like material formed into a rod shape. The structure of the wick forms a plurality of small bores or tubes, through which the liquid aerosol-forming substrate can be transported by capillary action. The capillary wick may comprise any suitable material or combination of materials. Examples of suitable materials are ceramic- or graphite-based materials in the form of fibres or sintered powders. The capillary wick may have any suitable capillarity and porosity so as to be used with different liquid physical properties such as density, viscosity, surface tension and vapour pressure. The capillary properties of the wick, combined with the properties of the liquid aerosol-forming substrate, ensure that the wick remains when as long as liquid aerosol-forming substrate remains in the liquid storage container.

In embodiments comprising a liquid transport element having a first portion positioned within a liquid storage container, the aerosol-generating element may be positioned to aerosolise the liquid aerosol-forming substrate at a second portion of the liquid transport element. In use, liquid aerosol-forming substrate is transferred from the liquid storage container towards the aerosol-generating element along the liquid transport element. When the aerosol-generating element is activated, liquid aerosol-forming substrate in the liquid transport element is vaporised by the aerosol-generating element to form a supersaturated vapour. The supersaturated vapour is mixed with and carried in airflow. During the flow, the vapour condenses to form an aerosol and the aerosol is carried towards the mouth of a user.

The aerosol-generating element may comprise a susceptor, wherein the susceptor is configured to aerosolise the liquid aerosol-forming substrate when the susceptor is inductively heated.

The controller may be configured to supply electrical power from the electrical power supply to the aerosol-generating element.

The aerosol-generating element may comprise a vibratable element, such as a piezoelectric element.

The aerosol-generating element may comprise a resistive heater. The resistive heater may comprise any of the resistive heaters described herein.

According to a third aspect of the present invention there is provided an aerosol-generating device comprising an elongate housing having a first end, a second end, and a longitudinal axis extending between the first end and the second end. The aerosol-generating device further comprises a cavity configured for insertion of an aerosol-generating article into the cavity along a first direction, wherein the first direction is substantially perpendicular to the longitudinal axis of the elongate housing. The aerosol-generating device also comprises an aerosol-generating cartridge comprising a liquid storage portion, a liquid aerosol-forming substrate contained within the liquid storage portion, and an aerosol-generating element configured for aerosolising the liquid aerosol-forming substrate. The aerosol-generating device comprises an electrical power supply positioned within the housing, and a controller positioned within the housing and configured to control a supply of electrical power from the electrical power supply to the aerosol-generating element.

The aerosol-generating element may comprise any of the aerosol-generating elements described herein with reference to the first and second aspects of the present invention.

The liquid aerosol-forming substrate may comprise any of the liquid aerosol-forming substrates described herein with reference to the first and second aspects of the present invention.

The aerosol-generating device may comprise at least one of an outlet in the liquid storage container and a liquid transport element, as described herein with reference to the first and second aspects of the present invention.

The aerosol-generating device may comprise any of the optional and preferred features described herein with reference to the first and second aspects of the present invention.

Preferably, the aerosol-generating device is configured so that, in use, airflow through the aerosol-generating device flows across the aerosol-generating element and through the cavity.

The aerosol-generating device may be configured so that, in use, airflow through the aerosol-generating device flows through the cavity before flowing across the aerosol-generating element.

The aerosol-generating device may be configured so that, in use, airflow through the aerosol-generating device flows through the cavity after flowing across the aerosol-generating element. In such an arrangement airflow across the aerosol-generating element may advantageously facilitate the vaporisation of one or more volatile compounds from an aerosol-generating article received within the cavity. Advantageously, this may eliminate the need to provide an electrical heater positioned within or proximate the cavity and configured to heat an aerosol-generating article received within the cavity.

In embodiments in which the aerosol-generating element is configured to heat the liquid aerosol-forming substrate during use, the aerosol-generating element may advantageously heat the airflow before the airflow passes through the cavity.

The liquid aerosol-forming substrate may comprise one or more components that, when aerosolised into the airflow during use, may facilitate the vaporisation of one or more volatile compounds from an aerosol-generating article received within the cavity. The liquid aerosol-forming substrate may comprise at least one of polyethylene glycol, glycerin, triacetin, and combinations thereof. An aerosol generated from a liquid aerosol-forming substrate comprising one or more of polyethylene glycol, glycerin and triacetin may facilitate the vaporisation of nicotine from an aerosol-generating article received within the cavity. In particular, an aerosol comprising one or more of polyethylene glycol, glycerin and triacetin may facilitate the vaporisation of deprotonated nicotine from an aerosol-generating article received within the cavity.

The aerosol-generating device may comprise at least one electrical heater positioned within or proximate the cavity, as described herein with reference to the first and second aspects of the present invention. Preferably, the controller is configured to control a supply of electrical power from the electrical power supply to the at least one electrical heater when an aerosol-generating article is received within the cavity.

According to a fourth aspect of the present invention there is provided an aerosol-generating system comprising an aerosol-generating device according to the third aspect of the present invention and an aerosol-generating article configured for insertion into the cavity.

Each of the aerosol-generating device and the aerosol-generating article may comprise any of the optional and preferred features described herein with reference to the first, second and third aspects of the present invention.

The liquid aerosol-forming substrate may comprise at least one of polyethylene glycol, glycerin, triacetin, and combinations thereof.

The aerosol-generating article may comprise an aerosol-forming substrate comprising nicotine, preferably deprotonated nicotine. The aerosol-forming substrate may comprise tobacco containing deprotonated nicotine. Deprotonated nicotine may be formed using known processes. Deprotonated nicotine may be formed by the addition of one or more basic materials.

Figure 2:
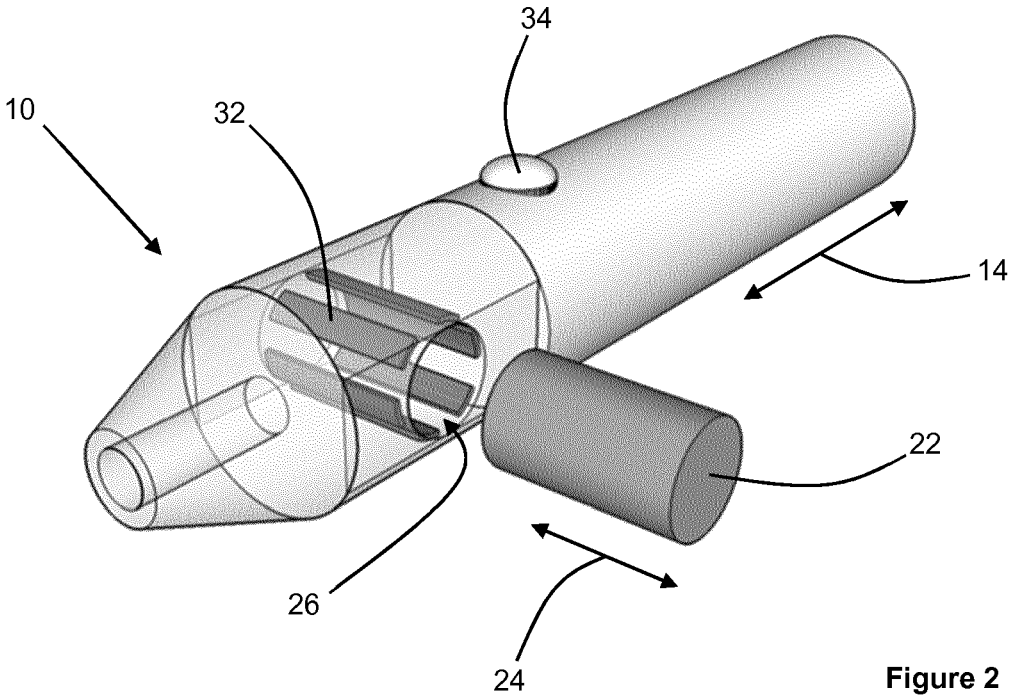
FIG. 2 shows a perspective view of the aerosol-generating device of FIG. 1 and an aerosol-generating article suitable for use with the aerosol-generating device.

FIG. 1 shows a cross-sectional view of an aerosol-generating device 10 in accordance with a first embodiment of the present invention. FIG. 2 shows a perspective view of the aerosol-generating article 10.

The aerosol-generating device 10 comprises an elongate housing 12 having a longitudinal axis 14 extending between a first end 16 of the elongate housing 12 and a second end 18 of the elongate housing 12. The elongate housing 12 defines a cavity 20 for receiving an aerosol-generating article 22. The cavity 20 extends substantially perpendicularly to the longitudinal axis 14 so that the aerosol-generating article 22 is inserted into the cavity 20 along a first direction 24 that is substantially perpendicular to the longitudinal axis. The housing 12 further defines a first aperture 26 positioned at a first end of the cavity 20 and extending through a portion of the elongate housing 12 for insertion of the aerosol-generating article 22 into the cavity 20 through the first aperture 26.

The aerosol-generating device 10 further comprises an electrical power supply 28 and a controller 30 positioned within the housing, and a plurality of electrical heaters 32 positioned within the cavity 20. During use, the controller 30 controls a supply of electrical power from the electrical power supply 28 to the electrical heaters 32 to heat the aerosol-generating article 22 received within the cavity 20. The aerosol-generating device 10 comprises a button 34 for activating the electrical heaters 32, the button 34 positioned on the outside of the elongate housing 12.

The first aperture 26 may form an airflow inlet in fluid communication with the cavity 20. The aerosol-generating device 10 further comprises a mouthpiece 36 formed integrally with the elongate housing 12 and defining an airflow outlet 38 in fluid communication with the cavity 20. During use, the electrical heaters 32 heat the aerosol-generating article 22 to release an aerosol into the cavity 20. A user draws on the mouthpiece 36 to draw air into the cavity 20 through the first aperture 26 and out of the cavity 20 through the airflow outlet 38.

Alternative to or in addition to the first aperture 26 forming an airflow inlet, the aerosol-generating device 10 may comprise one or more airflow inlets positioned elsewhere on the elongate housing 12. For example, the aerosol-generating device 10 may comprise at least one airflow inlet positioned at the first end 16 of the elongate housing 12. In embodiments in which the aerosol-generating device 10 comprises at least one airflow inlet upstream of the cavity 20 and in fluid communication with the cavity 20, a number of different airflow arrangements are possible.

Figure 3:
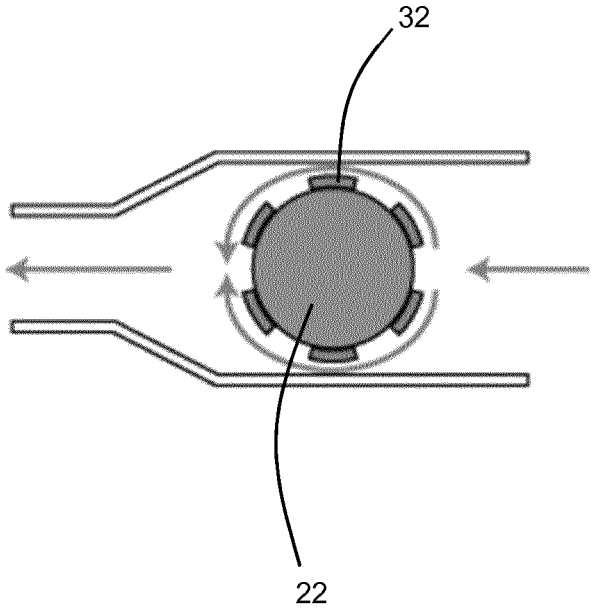
FIG. 3 shows a further cross-sectional view of the aerosol-generating device of FIG. 1, showing a first configuration of airflow through the cavity.
Figure 4:
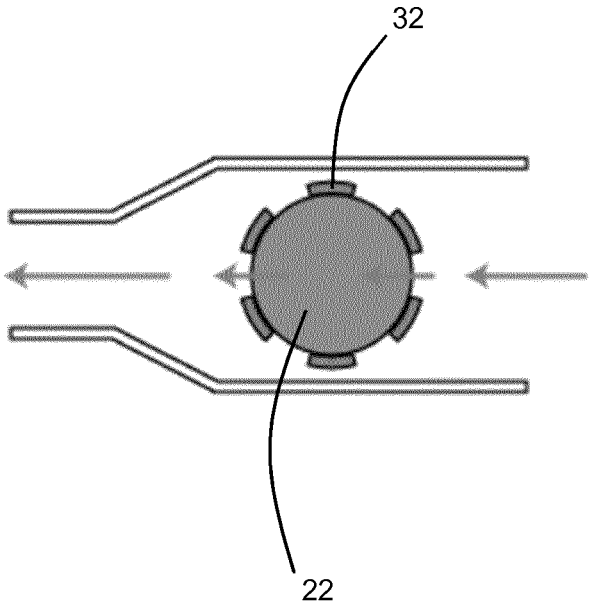
FIG. 4 shows a further cross-sectional view of the aerosol-generating device of FIG. 1, showing a second configuration of airflow through the cavity.
Figure 5:
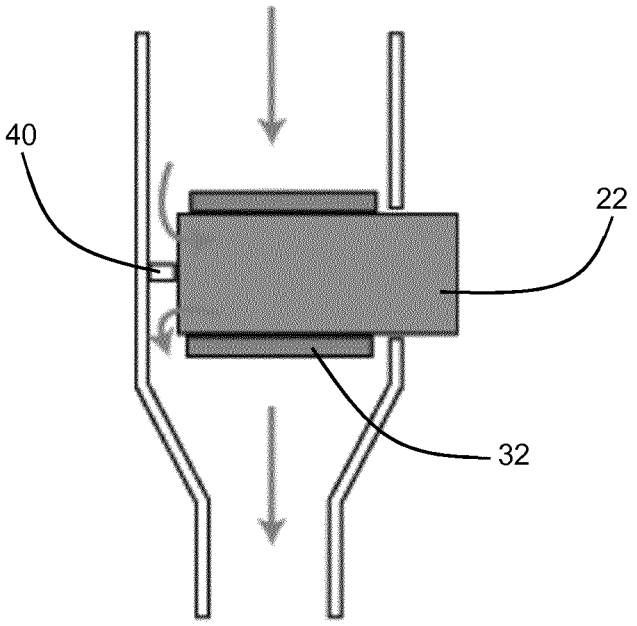
FIG. 5 shows a further cross-sectional view of the aerosol-generating device of FIG. 1, showing a third configuration of airflow through the cavity.

FIG. 3 illustrates a first airflow arrangement in which airflow through the cavity 20 flows around the outside of the aerosol-generating article 22. FIG. 4 illustrates a second airflow arrangement in which airflow through the cavity 20 flows through the aerosol-generating article 22 in the direction of the longitudinal axis 14. FIG. 5 illustrates a third airflow arrangement in which the aerosol-generating device 10 comprises a blocking element 40 configured to direct airflow into a first end of the aerosol-generating article 22 at an upstream side and out of the first end of the aerosol-generating article 22 at a downstream side. The aerosol-generating device 10 and the aerosol-generating article 22 may be configured so that airflow through the aerosol-generating device 10 comprises a combination of the different airflow arrangements shown in FIGS. 3 to 5.

Figure 6:
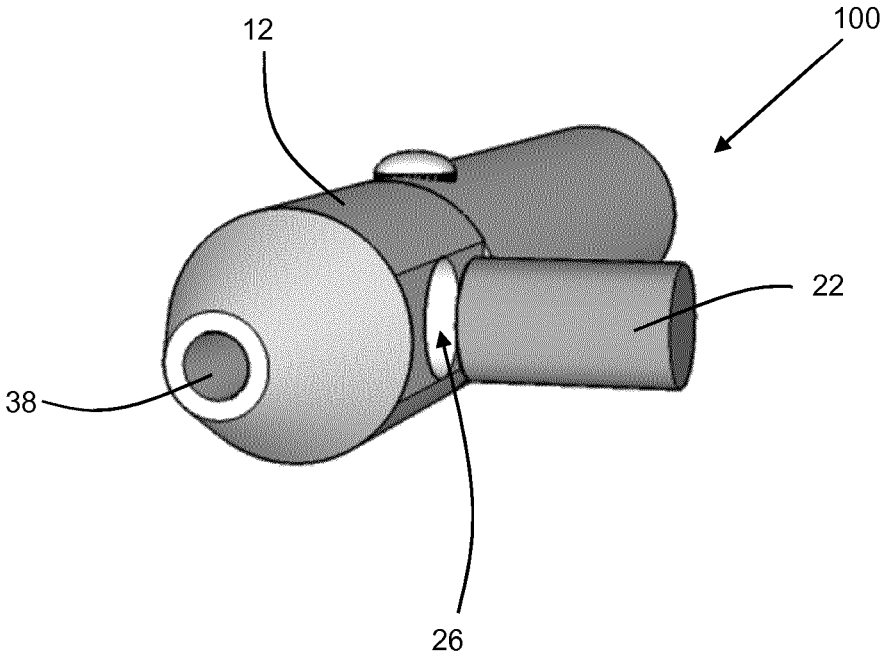
FIG. 6 shows a first perspective view of an aerosol-generating device according to a second embodiment of the present invention, together with an aerosol-generating article.
Figure 7:
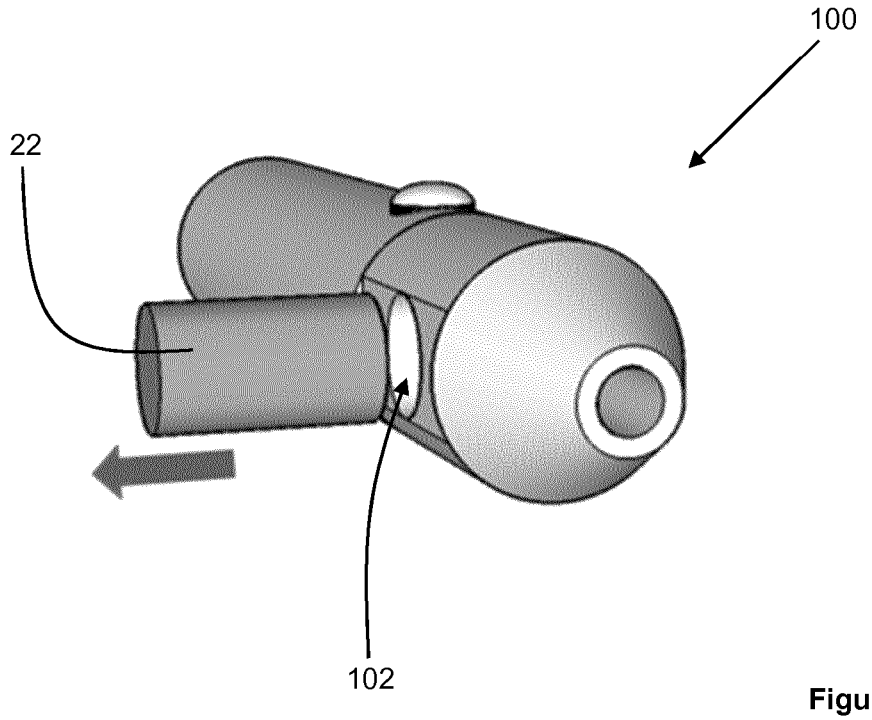
FIG. 7 shows a second perspective view of the aerosol-generating device and the aerosol-generating article of FIG. 6.

FIGS. 6 and 7 show perspective views of an aerosol-generating device 100 according to a second embodiment of the present invention, together with an aerosol-generating article 22. The aerosol-generating device 100 is substantially the same as the aerosol-generating device 10 described with reference to FIGS. 1 and 2, and like reference numerals are used to designate like parts.

The aerosol-generating device 100 differs from the aerosol-generating device 10 shown in FIG. 1 by the addition of a second aperture 102 positioned at a second end of the cavity 20. The second aperture 102 is sized so that the aerosol-generating article 22 may be inserted into either the first aperture 26 or the second aperture 102. Similarly, the aerosol-generating article 22 may be removed from either the first aperture 26 or the second aperture 102. To facilitate removal of the aerosol-generating article 22 from the cavity 20, a user may push the aerosol-generating article 22 via one of the apertures and out of the cavity 20 through the other aperture.

Figure 8:
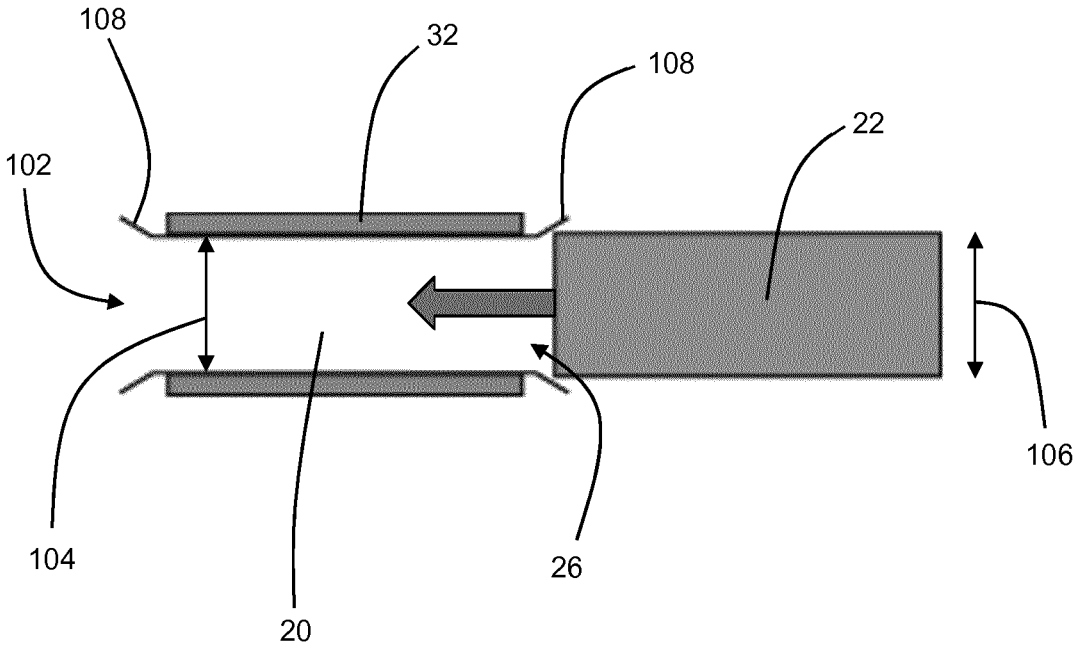
FIG. 8 shows a cross-sectional view of the aerosol-generating device and the aerosol-generating article of FIG. 6.

As shown in FIG. 8, the cavity 20 is sized to retain the aerosol-generating article 22 in the cavity 20 by an interference fit. Specifically, the cavity 20 has a width 104 that is slightly smaller than a width 106 of the aerosol-generating article 22. To facilitate insertion of the aerosol-generating article 22 into the cavity 20, each of the first aperture 26 and the second aperture 102 comprises a tapering portion 108.

Figure 9:
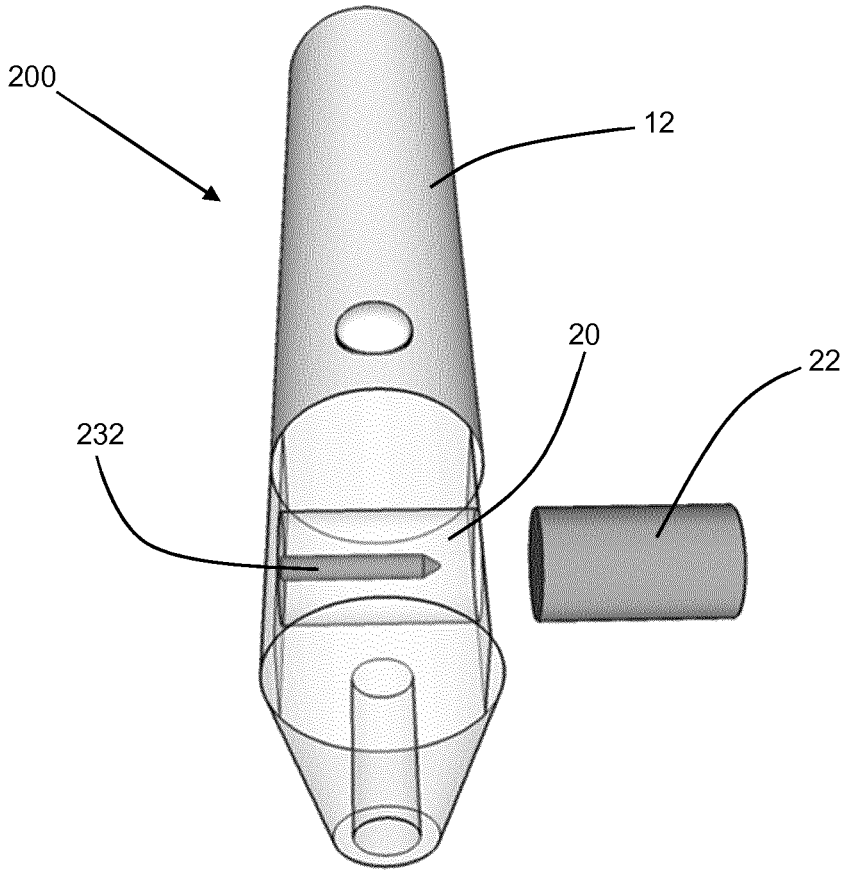
FIG. 9 shows a cross-sectional view of an aerosol-generating device in accordance with a third embodiment of the present invention.

FIG. 9 shows an aerosol-generating device 200 according to a third embodiment of the present invention, together with an aerosol-generating article 22. The aerosol-generating device 200 is substantially the same as the aerosol-generating device 10 described with reference to FIGS. 1 and 2, and like reference numerals are used to designate like parts.

The aerosol-generating device 200 differs from the aerosol-generating device 10 shown in FIG. 1 by the heating arrangement in the cavity 20. Instead of a plurality of electrical heaters positioned around an internal surface of the cavity 20, the aerosol-generating device 200 comprises a single electrical heater 232 extending from a wall of the cavity opposite the first aperture 26. The electrical heater 232 extends into the cavity 20 so that it pierces the aerosol-generating article 22 when the aerosol-generating article 22 is inserted into the cavity 20.

Figure 10:
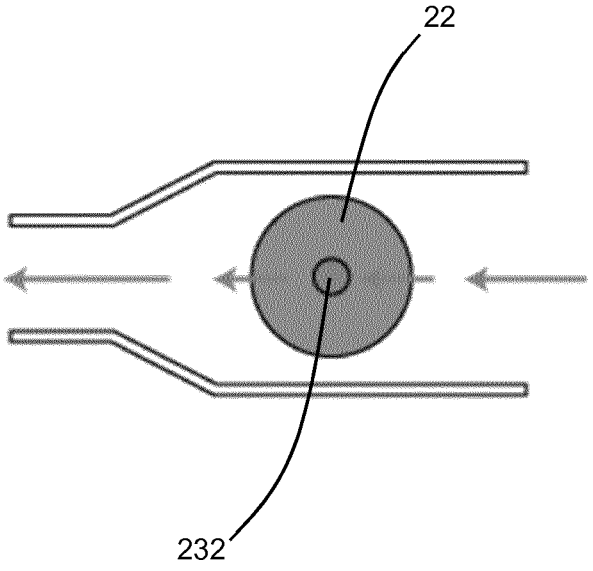
FIG. 10 shows a further cross-sectional view of the aerosol-generating device of FIG. 9, showing a first configuration of airflow through the cavity.
Figure 11:
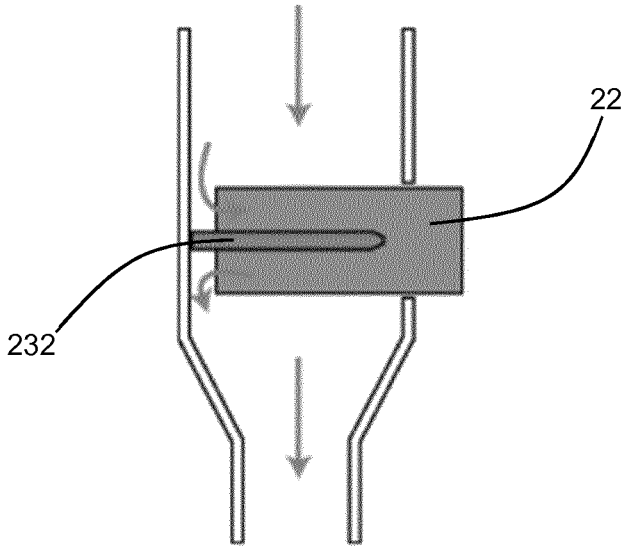
FIG. 11 shows a further cross-sectional view of the aerosol-generating device of FIG. 9, showing a second configuration of airflow through the cavity.

FIG. 10 illustrates a first airflow arrangement for the aerosol-generating device 200 in which airflow through the cavity 20 flows through the aerosol-generating article 22 in the direction of the longitudinal direction axis 14. FIG. 11 illustrates a second airflow arrangement in which the electrical heater 232 functions as a blocking element to direct airflow into a first end of the aerosol-generating article 22 at an upstream side and out of the first end of the aerosol-generating article 22 at a downstream side. In a further configuration, the aerosol-generating device 200 and the aerosol-generating article 22 may be configured so that airflow through the cavity 20 flows around the aerosol-generating article 22. The aerosol-generating device 200 and the aerosol-generating article 22 may be configured so that airflow through the aerosol-generating device 200 comprises a combination of these different airflow arrangements.

Figure 12:
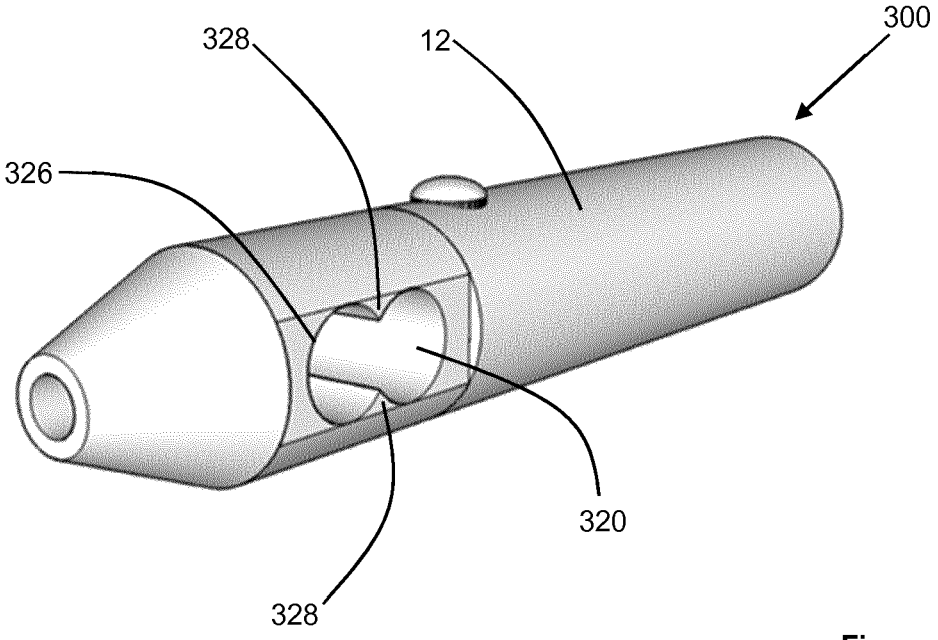
FIG. 12 shows a perspective view of an aerosol-generating device in accordance with a fourth embodiment of the present invention.

FIG. 12 shows an aerosol-generating device 300 according to a fourth embodiment of the present invention. The aerosol-generating device 300 is substantially the same as the aerosol-generating device 10 described with reference to FIGS. 1 and 2, and like reference numerals are used to designate like parts.

The aerosol-generating device 300 differs from the aerosol-generating device 10 shown in FIG. 1 by the arrangement of the cavity 320. The cavity 320 is configured to simultaneously receive two aerosol-generating articles. To ensure proper insertion of the two aerosol-generating articles into the cavity 320, the cavity 320 and the first aperture 326 comprise scalloped portions 328.

Figure 13:
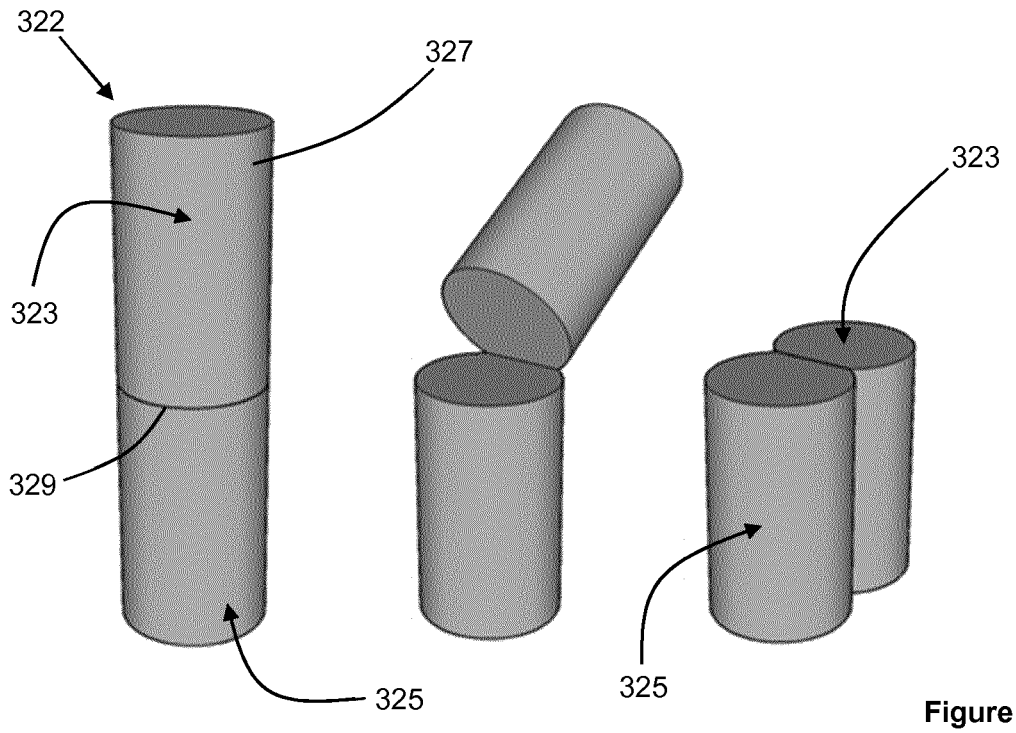
FIG. 13 shows a sequence of perspective views of an aerosol-generating article suitable for use with the aerosol-generating device of FIG. 12.

FIG. 13 shows a sequence of perspective views of an aerosol-generating article 322 suitable for use with the aerosol-generating device 300 of FIG. 12. The aerosol-generating article 322 comprises a first aerosol-generating article 323 and a second aerosol-generating article 325 connected to each other by a wrapper 327. The wrapper 327 comprises a frangible portion 329 along which the wrapper may be broken to at least partially detach the second aerosol-generating article 325 from the first aerosol-generating article 323. The first and second aerosol-generating articles 323, 325, when at least partially detached and placed next to each other, may be inserted into the cavity 320 of the aerosol-generating article 300.

Figure 14:
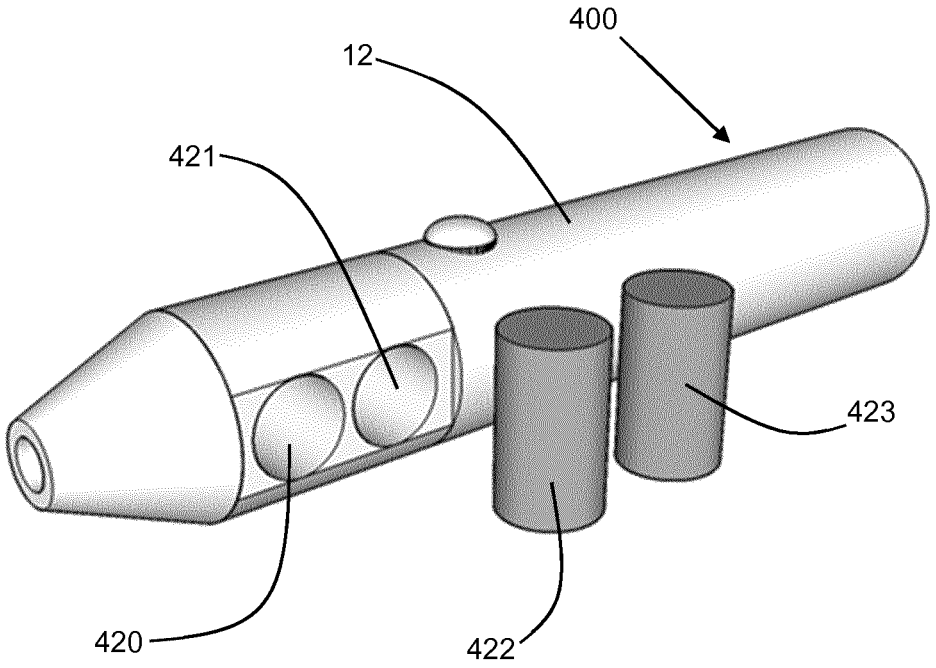
FIG. 14 shows a perspective view of an aerosol-generating device according to a fifth embodiment of the present invention.

FIG. 14 shows an aerosol-generating device 400 according to a fifth embodiment of the present invention. The aerosol-generating device 400 is substantially the same as the aerosol-generating device 300 described with reference to FIG. 12, and like reference numerals are used to designate like parts.

The aerosol-generating device 400 differs from the aerosol-generating device 300 shown in FIG. 12 by the arrangement of the cavity. The aerosol-generating device 400 comprises a first cavity 420 for receiving a first aerosol-generating article 422 and a separate second cavity 421 for receiving a second aerosol-generating article 423. The first and second aerosol-generating articles 422, 423 may be separately provided. Alternatively, an aerosol-generating article 322 as described with reference to FIG. 13 may be used, except the first and second aerosol-generating articles 323, 325 must be fully detached from each other before insertion into the first and second cavities 420, 421.

Figure 15:
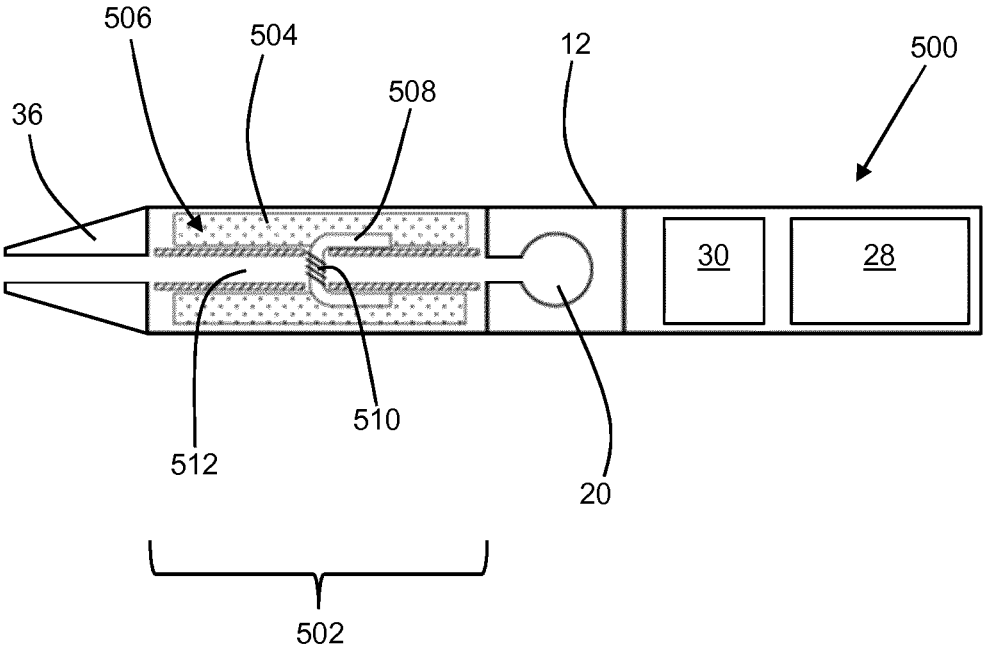
FIG. 15 shows a cross-sectional view of an aerosol-generating device according to a sixth embodiment of the present invention.

FIG. 15 shows a cross-sectional view of an aerosol-generating device 500 according to a sixth embodiment of the present invention. The aerosol-generating device 500 is similar to the aerosol-generating device 10 described with reference to FIGS. 1 and 2, and like reference numerals are used to designate like parts.

The aerosol-generating device 500 differs from the aerosol-generating device 10 shown in FIG. 1 by the addition of an integrated aerosol-generating article in the form of an aerosol-generating cartridge 502. The aerosol-generating cartridge 502 comprises a liquid storage portion 504 containing a liquid aerosol-forming substrate 506, a liquid transfer element 508 in the form of a capillary wick, and an aerosol-generating element 510 in the form of an electrical heater. An air passageway 512 extends through the aerosol-generating cartridge 502 to provide fluid communication between the cavity 20, the aerosol-forming cartridge 502 and the mouthpiece 36.

During use, liquid aerosol-forming substrate 506 is transferred by capillary action along the capillary wick from the liquid storage portion 504 to the electrical heater. The controller 30 controls a supply of electrical power from the electrical power supply 28 to the electrical heater to aerosolise the liquid aerosol-forming substrate 506 from the capillary wick and into the air passageway 512, forming a first aerosol. Simultaneously, an aerosol-generating article may be received within the cavity and heated, as described with reference to FIGS. 1 and 2, to provide a second aerosol. When a user draws on the mouthpiece 36, both the first and second aerosols are drawn into the mouthpiece and intermixed for delivery to the user. The second aerosol may impart a desired flavour profile to the first aerosol. For example, the liquid aerosol forming substrate 506 may comprise a nicotine solution, and the aerosol-generating article received within the cavity 20 may comprise at least one of tobacco and a flavourant.

Figure 16:
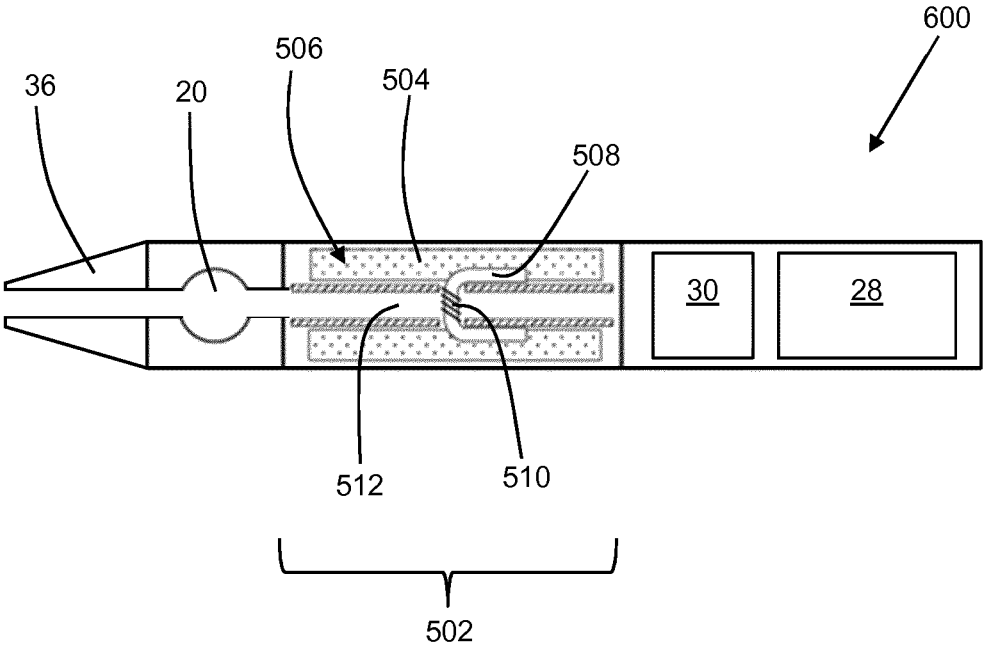
FIG. 16 shows a cross-sectional view of an aerosol-generating device according to a seventh embodiment of the present invention.

FIG. 16 shows a cross-sectional view of an aerosol-generating device 600 according to a seventh embodiment of the present invention. The aerosol-generating device 600 is substantially the same as the aerosol-generating device 500 described with reference to FIG. 15, and like reference numerals are used to designate like parts.

The aerosol-generating device 600 differs from the aerosol-generating device 500 shown in FIG. 15 by the relative positions of the cavity 20 and the aerosol-generating cartridge 502. Specifically, the aerosol-generating cartridge 502 is provided upstream of the cavity 20. Otherwise, the operation of the aerosol-generating device 600 is identical to the operation of the aerosol-generating device 500.

The invention claimed is:

1. An aerosol-generating device, comprising:

an elongate housing having a first end, a second end, and a longitudinal axis extending between the first end and the second end;

a cavity having a first end and a second end, and being configured for insertion of an aerosol-generating article into the cavity along a first direction that is substantially perpendicular to a longitudinal axis of the elongate housing;

a first aperture disposed at the first end of the cavity and extending through a first portion of the elongate housing, wherein the aerosol-generating device is configured for insertion of the aerosol-generating article into the cavity through the first aperture;

a second aperture disposed at the second end of the cavity and extending through a second portion of the elongate housing, wherein the aerosol-generating device is configured for removal of the aerosol-generating article from the cavity through the first aperture or the second aperture, or through the first aperture and the second aperture;

an electrical power supply disposed within the elongate housing;

at least one electrical heater; and a controller disposed within the elongate housing and configured to control a supply of electrical power from the electrical power supply to the at least one electrical heater when the aerosol-generating article is received within the cavity.

2. The aerosol-generating device according to claim 1, wherein the first aperture or the cavity comprises a tapering portion, and wherein a cross-sectional area of the tapering portion decreases along the first direction.

3. The aerosol-generating device according to claim 1, wherein the first aperture or the second aperture, or the first aperture and the second aperture, forms an airflow inlet.

4. The aerosol-generating device according to claim 1, further comprising at least one airflow inlet disposed at the first end of the elongate housing, wherein the at least one airflow inlet is in fluid communication with the cavity.

5. The aerosol-generating device according to claim 1, further comprising at least one airflow outlet disposed at the second end of the elongate housing, wherein the at least one airflow outlet is in fluid communication with the cavity.

6. The aerosol-generating device according to claim 5, further comprising a mouthpiece disposed at the second end of the elongate housing, wherein the at least one airflow outlet is in fluid communication with the mouthpiece.

7. The aerosol-generating device according to claim 1, wherein the at least one electrical heater is disposed within the cavity.

8. The aerosol-generating device according to claim 7, wherein the at least one electrical heater comprises a plurality of electrical heaters spaced around an internal wall of the cavity.

9. The aerosol-generating device according to claim 1, wherein the at least one electrical heater comprises at least one elongate electrical heater disposed on an internal wall of the cavity, the at least one elongate electrical heater extending into the cavity from the internal wall.

10. The aerosol-generating device according to claim 1, wherein the cavity is configured to simultaneously receive a plurality of aerosol-generating articles.

11. The aerosol-generating device according to claim 1, wherein the cavity is a first cavity configured for insertion of a first aerosol-generating article into the first cavity along the first direction, the aerosol-generating device further comprising a second cavity configured for insertion of a second aerosol-generating article into the second cavity along a second direction, and wherein the second direction is substantially perpendicular to the longitudinal axis of the elongate housing.

12. The aerosol-generating device according to claim 11, wherein the first direction is substantially parallel to the second direction.

13. An aerosol-generating system comprising an aerosol-generating device according to claim 1, and an aerosol-generating article configured for insertion into the cavity.

14. The aerosol-generating system according to claim 13, wherein the aerosol-generating system is configured so that the aerosol-generating article is retained within the cavity by an interference fit when the aerosol-generating article is received within the cavity.

* * * * *